United States Patent [19]

Burrows et al.

[11] Patent Number: 4,644,674

[45] Date of Patent: Feb. 24, 1987

[54] ALLOY FOR COINS

[75] Inventors: George R. Burrows, Dudley; Ian R. Scholes, Sutton Coldfield, both of England

[73] Assignee: The Deputy Master and Controller Royal Mint, Wales, United Kingdom

[21] Appl. No.: 668,274

[22] PCT Filed: Feb. 27, 1984

[86] PCT No.: PCT/GB84/00062

§ 371 Date: Oct. 30, 1984

§ 102(e) Date: Oct. 30, 1984

[87] PCT Pub. No.: WO84/03522

PCT Pub. Date: Sep. 13, 1984

[30] Foreign Application Priority Data

Mar. 1, 1983 [GB] United Kingdom ..... 8305610

[51] Int. Cl.[4] ..... C22C 9/04

[52] U.S. Cl. ..... 40/27.5; 420/473; 420/476; 428/674

[58] Field of Search ..... 420/473, 476, 477, 481, 420/485; 428/674–677; 148/411–414, 432–435, 11.5 C; 40/27.5

[56] References Cited

U.S. PATENT DOCUMENTS

| | | | |
|---|---|---|---|
| 1,988,938 | 1/1935 | Corson | 420/473 |
| 4,436,790 | 3/1984 | Prinz et al. | 428/675 |
| 4,579,761 | 4/1986 | Ruscoe et al. | 40/27.5 |

FOREIGN PATENT DOCUMENTS

| | | | |
|---|---|---|---|
| 2251058 | 5/1973 | Fed. Rep. of Germany | 420/481 |
| 442593 | 2/1936 | United Kingdom . | |

OTHER PUBLICATIONS

Chem. Abst., 95: 224093g, 1981.
Chem. Abst., 97: 149364g, 1982.
Chem. Abst., 98: 184216c, 1982.
Chem. Abst., 99: 26422h, 1983.

*Primary Examiner*—L. Dewayne Rutledge
*Assistant Examiner*—John J. Zimmerman
*Attorney, Agent, or Firm*—Stevens, Davis, Miller & Mosher

[57] ABSTRACT

A coin, a coin blank or metal strip for the production of a coin or a coin blank having as its surface a copper based alloy containing between 15% and 30% (by wt) zinc, between 2% and 7% (by wt) tin and, optionally, between 2% and 7% (by wt) nickel. The alloy is gold-colored, tarnish resistant, fabricable and wear resistant.

16 Claims, 2 Drawing Figures

COLOUR DISTRIBUTION BY ALLOY NUMBER

ALLOY FOR COINS

Figure 1:
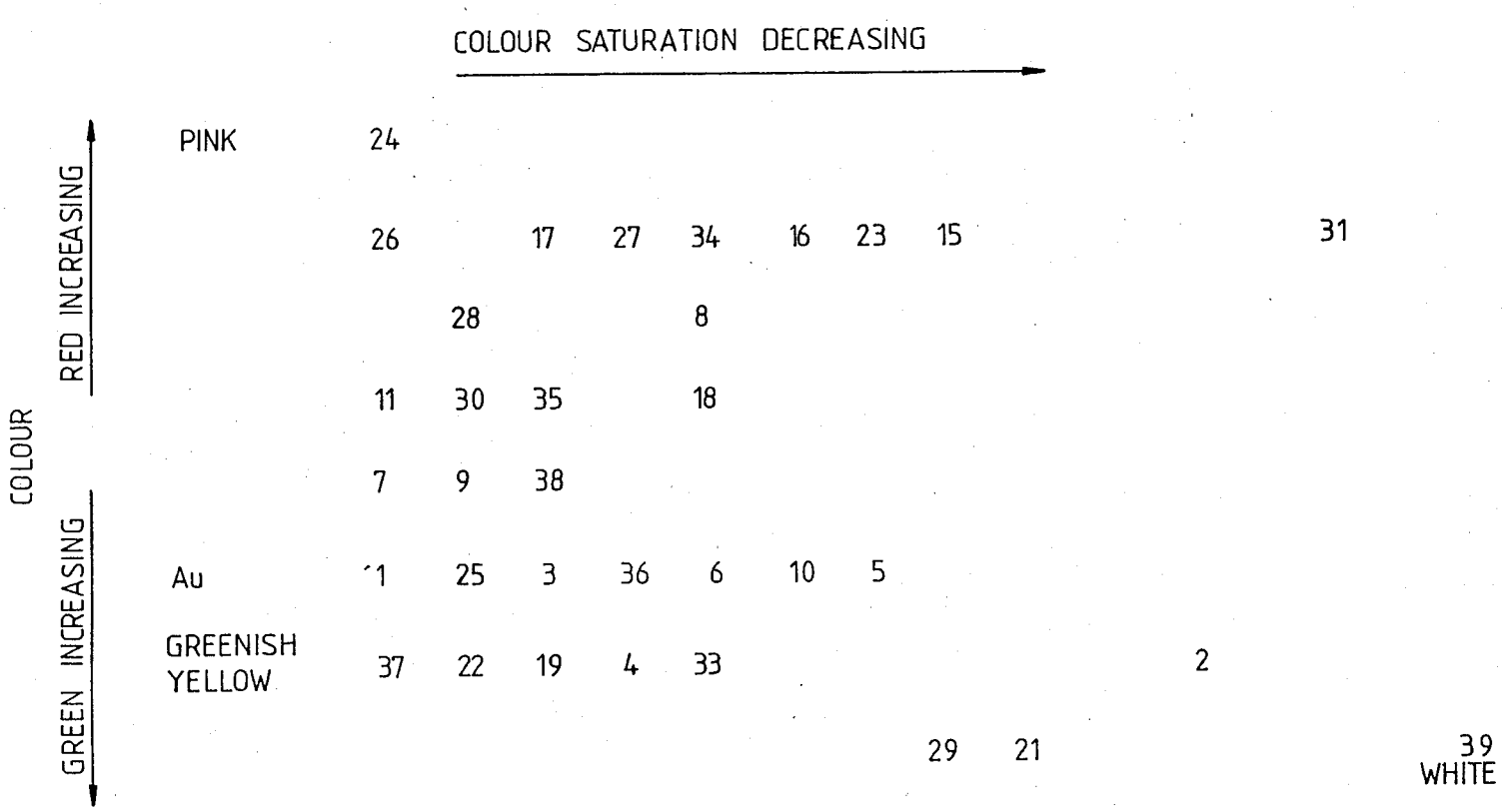

This invention relates to coins, coin blanks, metal for the production of coins or coin blanks and alloys for such uses. The term coin as used herein also covers tokens, medals and the like.

Over very many years numerous alloys have been used in the manufacture of coins. With the increasing tendency to produce high value coins—which may be utilised for vending machines and replace paper money which has a very short life—there has arisen a need to develop alloys which are attractive in color. Historically many high value coins were made from gold or gold alloys and the general public associates golden coins with high value coins. There is, therefore, a wish to develop coin alloys for high value coins which are golden in appearance.

Apart from gold itself the only yellow alloys contain copper, and brasses containing about 15% of zinc approach closest to the color of gold. Unfortunately brasses have inadequate tarnish resistance.

Although pure gold has a constant color it is impracticable to make coins from pure gold because pure gold is very soft. Gold coins have, therefore, to be made from a gold based alloy. The actual color of the alloy can depend on the actual alloying element added to the gold and the quantity of that element. Typically the addition of copper to gold will tend to make it redder whereas silver additions make gold appear whiter in color.

Because the existing gold alloys can have differing color it is possible that some countries would require alloys having a more red color whereas other countries would require alloys having a whiter color if they were to introduce coins which the public associates with high value currency.

Coin alloys have a number of requirements, some of which tend to be unique to coins. A coin alloy has to be such that it is fabricable into a coin, the alloy has to have sufficient ductility to enable it to be struck or minted as a coin, and after minting it has to be sufficiently hard to withstand normal everyday usage. The coins themselves have to be resistant to wear and have to be tarnish resistant. Because the alloys will tarnish to some extent the color of the tarnish is important and also the contrast between the original metal and the tarnish color is significant. In use tarnishing will be more evident in recesses in the coin whereas the high points of the coin tend to be kept fairly clean. It is undesirable, therefore, that the tarnish color should differ too significantly from the bulk alloy color.

The coin alloy has to be capable of being annealed and ideally should be such that it could be clad onto a base metal such as steel for further cheapening of the coin product.

Ideally the alloy should have a fine grained, homogeneous single phase structure, should be easily castable and should not work harden too greatly during manufacture. The alloy must be capable of being readily cleaned to remove any oxide film and be capable of being rimmed and minted.

It can be seen, therefore, that a coin alloy has a number of requirements, many of which are unique to coins. In many cases some of the properties are difficult to determine. Thus it is difficult to predict the type of tarnish an alloy will develop in normal use. Over a period of years a coin may develop a tarnish which is unattractive and which does not tend to show up in accelerated tarnishing tests.

These numerous requirements of a coin alloy tend to mean that prior art descriptions of alloys which make no reference to coins do not enable the man skilled in the art to determine from inspection whether an alloy is suitable for use as a coin, a coin blank, or for the production of coins or coin blanks.

By the present invention there is provided a coin, a coin blank or a strip of metal for the production of a coin or coin blank having as its surface a copper based alloy containing 15 to 30% zinc and 2 to 7% tin apart from incidental impurities.

The alloy may additionally contain up to 7% nickel. The nickel content may be in the range 2 to 7%.

Preferably the zinc content is in the range 20 to 25% and may be 20% or 25%. The tin content may be 3 to 6% or 4% or 5%, and may be 3% or 6%. The nickel content may be 3 to 6% or 4% or 5%, or may be 3% or 6%.

Particularly advantageous compositions are copper, 25% zinc, 5% tin, 5% nickel; copper, 20% zinc, 4% tin, 4% nickel; copper, 20% zinc, 5% tin, 2% nickel; copper, 20% zinc, 5% tin; and copper, 25% zinc, 3% or 5% tin and 3% or 5% nickel.

The coin, coin blank or strip may be composed solely of the alloy or may have a core of a metal different to that of the alloy. The core may be steel or any other metal of a suitable combination of price and properties. The core may be completely surrounded by the alloy, including around the edge of the coin. Alternatively the coin may be struck from a sheet having outer layers of the alloy and a central core of a different metal.

The optimum tin content appears to be in the range $4\frac{1}{2}$ to $5\frac{1}{2}$%. As the tin content falls below 4% there is a measurable fall off in tarnish resistance, which becomes significant at 3% and with tin contents below 2% the tarnish resistance is unacceptably low. As the tin content increases above $5\frac{1}{2}$% the material becomes increasingly difficult to fabricate. It has been concluded that with tin contents above about 7% the formation of duplex structures comprising alpha and delta phases in eutectoid form increases the tendency to rapid work hardening. This necessitates frequent interstage anneals during cold rolling of the strip. Furthermore the hard eutectoid gives rise to increased wear in the dies used to mint the coins. Thus manufacture of coins from such materials becomes increasingly uneconomic for engineering reasons in addition to the high intrinsic material costs.

Nickel additions appear to be beneficial in terms of the improvement in tarnish resistance. However, as the nickel content increases it tends to bleach out the colour of the alloy, and also forms a copper/tin/nickel intermetallic compound which reduces the fabricability of the alloy. For coin applications this combination of problems imposes a limit on nickel content of 7%.

The zinc content of the alloy has a significant effect on its colorless and also on its tarnish resistance. Whereas nickel bleaches the alloy without significantly affecting the hue of the colorless, zinc affects the colour of the alloy to remove the redness of the copper to make it more golden. The zinc content has to be a minimum of 15% to give the required golden colour to the alloy. As the zinc content increases from 15% the tarnish resistance of the alloy increases, because the colourless zinc oxide formed is protective. However, as the zinc content increases to levels above 22% there is formed an alpha plus delta structure which may give fabrication problems at zinc contents in excess of 25%. The limit of zinc content of 30% is that at which the amount of alpha plus delta structures gives significant problems such that zinc contents above 30% are unacceptable particularly for alloys containing 5% tin.

Because the properties required for golden coin alloys are so peculiar to coins, it is not possible to predict what alloys would be suitable for use as coins. It will also be shown below that certain properties, including appearance and tarnish resistance, are only capable of a subjective assessment. Furthermore the properties vary with time of exposure and different alloys can be ranked differently according to the properties measured. This problem of the combination of properties and the variation of properties with the time of exposure makes the selection of coin alloys unusually difficult and makes the prediction of properties virtually impossible. Thus if it were possible to predict a property such as tarnish resistance the rankings of different alloys would not be expected to vary with exposure time, as is found to be the case in practice.

All references herein to percentages are references to weight percentage.

Figure 2:
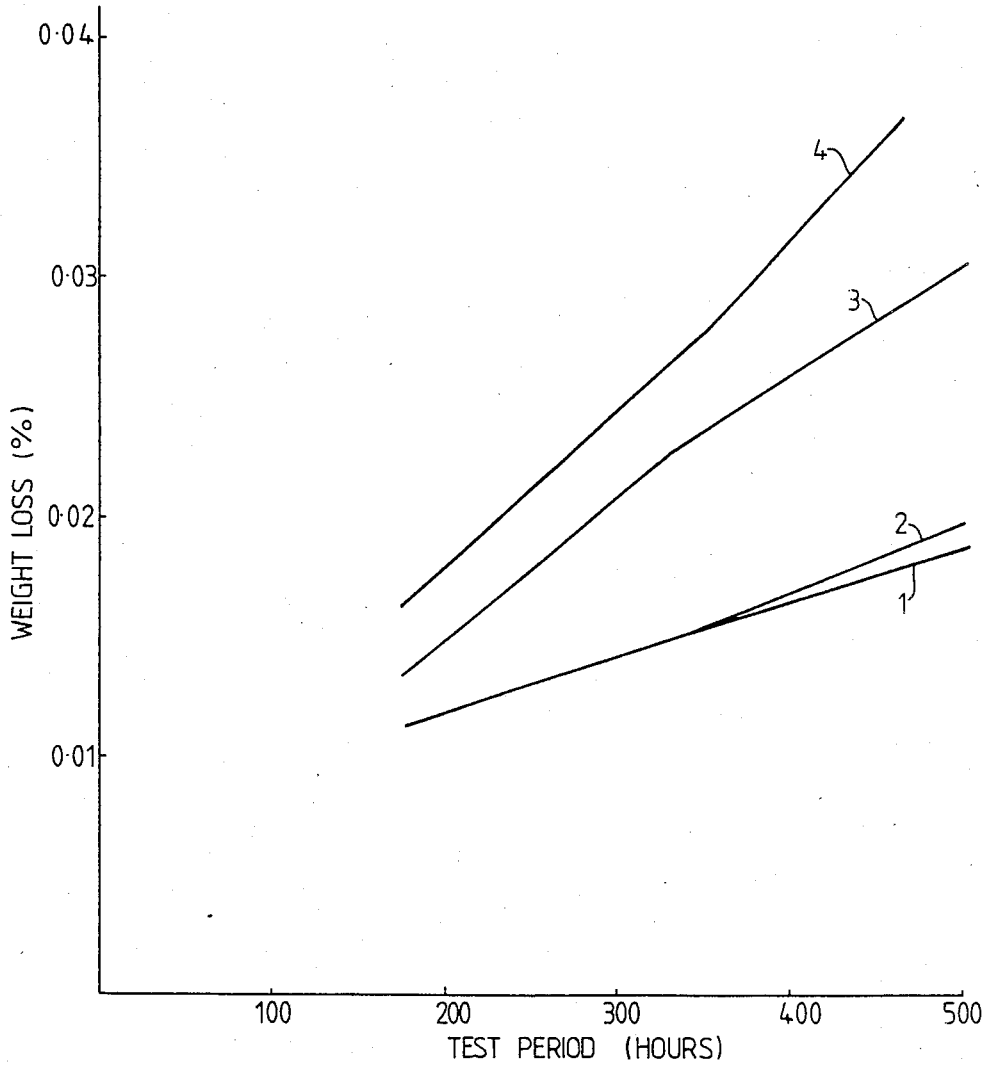

By way of example embodiments of the present invention will now be described with reference to the accompanying drawings, of which FIG. 1 is a chart of alloy against color and saturation; and FIG. 2 is a graph of weight loss in percent against test period in hours for a number of alloys.

When designing a new alloy which is intended for use in coinage applications and desirably has a gold color it is clearly a requirement that the alloy should at least match the properties of existing alloys which may be deemed suitable.

As a result a series of tests were carried out comparing a large number of alloys of the prior art, modifications of the prior art and alloys which were very different to the prior art. The alloys were cast, homogenised and rolled to form strip. From the strip blanks were cut and trial coins were struck from the blanks. Pocket trials were then carried out on the samples. A pocket trial comprises carrying around in the pocket of an individual sets of the coins and then visually assessing the coins to check on their color, their tarnishing, their appearance, wear and other characteristics relevant to coins. It will be appreciated that such visual assessment is a subjective assessment rather than an objective assessment. Consequently rankings in tables where subjective assessments are required must be regarded in general terms as subject to sligh variation depending on the particular observer. Normally two or more observers inspect the coins and rank them on several occasions. The overall rankings are then determined by averaging the individual rankings produced by the individual assessors. The results were assessed after 1 to 4 months exposure and after 6 to 9 months exposure. The results are given in Table I.

TABLE I

Results of Pocket Trials

| First Results | | | Second Results | | | |
|---|---|---|---|---|---|---|
| Rank | Alloy | Test Time | Rank | Rank in First Results | Alloy | Test Time |
| 1 | 20Zn—20Ni | b | 1 | 1 | 20Zn—20Ni | a |
| 2 | 25Zn—5Sn—5Ni | a | 1 | 2 | 25Zn—5Sn—5Ni | b |
| 3 | 7Sn—3Al | b | 3 | 6 | 40Zn—10Ni | |
| 4 | 24Zn—5.5Ni—0.3Mn | | 3 | 12 | 20Zn—5Sn | |
| 5 | 2Sn—7Al | a | 5 | 9 | 2Ni—6Al | b |
| 6 | 40Zn—10Ni | | 6 | 5 | 2Sn—7Al | a |
| 7 | 5Sn—10Ni | b | 6 | 3 | 7Sn—3Al | b |
| 8 | 2Ni—8Al | | 8 | 4 | 24Zn—5.5Ni—0.3Mn | |
| 9 | 5Ni—8Al | | 9 | 8 | 2Ni—8Al | |
| 9 | 2Ni—6Al | b | 10 | 9 | 5Ni—8Al | |
| 11 | 2Sn—9Ni | b | 10 | 14 | 19Zn—7Ni—2Al | b |
| 12 | 20Zn—5Sn | | 12 | 11 | 2Sn—9Ni | b |
| 13 | 5Zn—5Al | | 13 | 7 | 5Sn—10Ni | |
| 14 | 20Zn—4Al | | 14 | 13 | 5Zn—5Al | |
| 14 | 19Zn—7Ni—2Al | b | 15 | 14 | 20Zn—4Al | |
| 16 | 30Zn—2Si | | 16 | 18 | 30Zn—5Sn | |
| 17 | 6Ni—2Al | | 17 | 16 | 30Zn—2Si | |
| 18 | 30Zn—5Sn | | 18 | 20 | 20Zn—4Si | |
| 18 | 20Zn—1Ni | | 18 | 22 | 40Zn | |
| 20 | 20Zn—4Si | | 20 | 18 | 20Zn—1Ni | |
| 21 | 5Sn—10Mn | b | 21 | 17 | 6Ni—2Al | |
| 22 | 40Zn | | 22 | 21 | 5Sn—10Mn | b |
| 23 | 22Zn—2Mg | a | 23 | 23 | 22Zn—2Mg | a |

All alloys balance copper

| Test duration at | First Results | Second Results |
|---|---|---|
| a | 5 weeks | 6 months |
| b | 2 months | 7 months |
| other | 3–4 months | 8–9 months |

It can be seen that certain of the alloys, such as the alloy 20% zinc-5% tin, improves in its ranking quite dramatically between the first and second test results. In general terms the top four alloys were the 20% zinc-20% nickel-balance copper alloy, the 25% zinc-5% tin-5% nickel alloy, the 40% zinc-10% nickel alloy and the 20% zinc-5% tin alloy.

The alloys contained in Table I all were copper based alloys and copper comprises the balance of the alloys. The copper content is not shown as such in the Table.

The alloys tested together with certain other alloys were then ranked by color. FIG. 1 shows the color distribution by alloy number. Moving from the left to right the colour saturation decreases, i.e. the alloys become paler in color. From the gold line (Au) the alloys become redder as they go up the distribution chart and become more greenish-yellow to white as they go down the chart. In general terms, therefore, from the gold line red increases upwards and green increases downwards. The alloy compositions referred to in the chart are given in Table II below.

TABLE II

| Alloy No | Composition |
|---|---|
| 1 | Cu—20Zn—4Al |
| 2 | Cu—40Zn—10Ni |
| 3 | Cu—20Zn—5Sn |
| 4 | Cu—30Zn—5Sn |
| 5 | Cu—20Zn—4Si |
| 6 | Cu—30Zn—2Si |
| 7 | Cu—5Zn—5Al |
| 8 | Cu—5Al—5Ni |
| 9 | Cu—8Al—2Ni |
| 10 | Cu—8Al—5Ni |
| 11 | Cu—7Al—2Sn |
| 15 | Cu—5Sn—10Mn |
| 16 | Cu—10Mn—2Al |
| 17 | Cu—6Ni—2Al |
| 18 | Cu—6Al—2Ni |
| 19 | Cu—22Zn—2Mg |
| 21 | Cu—19Zn—7Ni—2Al |
| 22 | Cu—22Zn—1Al—1Mg |
| 23 | Cu—10Ni—5Sn |
| 24 | Cu—2.5Zn—0.5Sn |
| 25 | Cu—20Zn—1Ni |
| 26 | Cu—5Sn |
| 27 | Cu—3Si—1Mn |
| 28 | Cu—12Sn |
| 29 | Cu—24Zn—5.5Ni—0.3Mn |
| 30 | Cu—7Al—0.3Sn—0.1Ag |
| 31 | Cu—25Ni |
| 33 | Cu—25Zn—5Sn—5Ni |
| 34 | Cu—9Ni—2Sn |
| 35 | Cu—7Sn—3Al |
| 36 | Cu—20Zn |
| 37 | Cu—30Zn |
| 38 | Cu—40Zn |
| 39 | Cu—20Zn—20Ni |

The quaternary copper-zinc-tin-nickel alloys also have good tarnish resistance and good fabrication properties with a good color.

To investigate further the copper-zinc-tin and copper-zinc-tin-nickel alloys, two series of copper alloys were manufactured, namely Series 3 (copper, 20% zinc, 5% tin) and Series 33 (copper, 25% zinc, 5% tin, 5% nickel). The alloys were cast and, after casting were homogenised by being maintained at a temperature of approximately 650° C. for 16 hours. Homogenization is necessary with tin-containing alloys as they have a tendency to segregate in casting. Homogenization enables the dendritic structure of the cast material to diffuse out and the tin permeates throughout the metal being homogenised. Care has to be taken with alloys containing more than 3% tin to prevent tin sweat—the formation of rich deposits of tin on the surface of the alloy as a result of inverse segregation. The presence of local high tin regions can give rise to the formation of complex copper-nickel-tin phases which can give fabrication problems.

After homogenised the alloys were cold rolled to 2 mm strip with interstage annealing as necessary during the rolling. After the strip had been formed the material was examined and it was found that initial fine surface fissuring of the alloys had not led to catastrophic break up, but for the best surface finish, the alloys needed dressing during the early stages of rolling. Dressing comprises the use of a milling or grinding machine to remove any surface cracks. The hard rolled strip was cleaned and blanks were cut from the strip using conventional punch and die blanking tools. The blanks were subsequently annealed and cleaned. The cleaned and annealed blanks were rimmed dry and samples of each alloy were struck to form coins. The resistivity of the alloys was measured on an inductance instrument. Resistivity is important in connection with vending machines which use the resistivity to determine that fake coins are not used to cheat the machine. The resistivity and color of the alloys is given in Table III.

| Alloy Number | Nominal Composition % | Resistivity ($\mu\Omega \cdot cm$) Cold Rolled | Annealed | Color |
|---|---|---|---|---|
| 3 | Cu—20Zn—5Sn | 10.8 | 9.7 | Golden Yellow |
| 3/1 | Cu—20Zn—3½Sn | 9.2 | 8.4 | Golden Yellow |
| 3/2 | Cu—20Zn—4½Sn | 10.0 | 9.4 | Golden Yellow |
| 3/3 | Cu—20Zn—5½Sn | 11.3 | 10.4 | Golden Yellow |
| 33 | Cu—25Zn—5Sn—5Ni | 16.5 | 16.0 | Greenish yellow |
| 33/1 | Cu—25Zn—3Sn—5Ni | 16.3 | 15.7 | Greenish yellow, darker than Alloy 33 |
| 33/2 | Cu—25Zn—5Sn—3Ni | 12.1 | 13.6 | Greenish yellow, slightly darker than Alloy 33 |
| 33/3 | Cu—20Zn—4Sn—5Ni | 16.1 | 15.7 | Pale pink-yellow |
| 33A | Cu—20Zn—2Sn—2Ni | 10.5 | 9.8 | Pale yellow, slightly darker than Alloy 33 |
| 33B | Cu—20Zn—2Sn—5Ni | 15.7 | 14.2 | Pink-yellow |
| 33C | Cu—20Zn—3Sn—3Ni | 13.1 | 12.1 | Pale yellow |
| 33D | Cu—20Zn—4Sn—4Ni | 15.5 | 14.4 | Similar to Alloy 33/1 |
| 33E | Cu—20Zn—5Sn—2Ni | 14.9 | 12.5 | Pale yellow |
| 33F | Cu—20Zn—2Sn—4Ni | 13.2 | 12.6 | Similar to Alloy 33/1 |
| 33G | Cu—20Zn—4Sn—2Ni | 13.2 | 11.6 | Pale yellow |
| 33H | Cu—20Zn—3Sn—2Ni | 12.3 | 10.8 | Pale yellow |
| 33I | Cu—20Zn—2Sn—3Ni | 12.2 | 11.2 | Pale yellow |

Comparing the results of the color distribution with the tarnish results given in Table I it can be seen that for the copper-zinc-tin alloys, tin in amounts of 4.5 to 5.5% gives significant tarnish resistance with a negligible color change. Alloys containing about 5% tin have an attractive golden yellow color and are capable of fabrication to coins without significant difficulty.

A series of tests were then carried out on the alloys. In tarnish tests the alloys were mounted vertically on edge and exposed to a mist of a synthetic acid sweat solution. This solution contained sodium chloride, lactic acid and anhydrous disodium orthophosphate. The solution was adjusted to a pH of 5.5. The results of the tarnish tests were estimated visually and were ranked in the order given in Table IV, the least tarnished sample being at the top of the Table.

TABLE IV

| | Static Tarnish Tests in Synthetic Sweat Mist 4 Hours Exposure | | | |
|---|---|---|---|---|
| | Alloy No | % Zn | % Sn | % Ni |
| 1 | 33F | 20 | 2 | 4 |
| 2 | 33 | 25 | 5 | 5 |
| 3 | 33/1 | 25 | 3 | 5 |
| 4 | 33/2 | 25 | 5 | 3 |
| 5 | 33A | 20 | 2 | 2 |
| 6 | 33E | 20 | 5 | 2 |
| 7 | 33B | 20 | 2 | 5 |
| 8 | 33C | 20 | 3 | 3 |
| 9 | 33D | 20 | 4 | 4 |
| 10 | 33/3 | 20 | 4 | 5 |
| 11 | 33H | 20 | 3 | 2 |
| 12 | 3 | 20 | 5 | |
| 13 | 3/3 | 20 | 5½ | |
| 14 | 3/1 | 20 | 3½ | |
| 15 | 33G | 20 | 4 | 2 |
| 16 | 3/2 | 20 | 4½ | |
| 17 | 33I | 20 | 2 | 3 |

To determine the wear properties of the alloy trial coins were minted and placed in a drum which was rotated at a slow speed such that the coins tumbled in the drum in the presence of pieces of "Terylene" (Registered Trade Mark) cloth that had been impregnated with an artificial sweat solution. The test was run for 672 hours, and tarnish assessment was again ranked visually and the results are given in Table V below.

TABLE V

| | Tarnish Assessment in Environmental Wear Test Test Duration 672 Hours | | | |
|---|---|---|---|---|
| | Alloy No | % Zn | % Sn | % Ni |
| 1 | 33/3 | 20 | 4 | 5 |
| 2 | 33G | 20 | 4 | 2 |
| 3 | 3 | 20 | 5 | |
| 4 | 3/2 | 20 | 4½ | |
| 5 | 33I | 20 | 2 | 3 |
| 6 | 33E | 20 | 5 | 2 |
| 7 | 33/1 | 25 | 3 | 5 |
| 8 | 33D | 20 | 4 | 4 |
| 9 | 33F | 20 | 2 | 4 |
| 10 | 33C | 20 | 3 | 3 |
| 11 | 33 | 25 | 5 | 5 |
| 12 | 3/3 | 20 | 5½ | |
| 13 | 3/1 | 20 | 3½ | |
| 14 | 33A | 20 | 2 | 2 |
| 15 | 33/2 | 25 | 5 | 3 |
| 16 | 33B | 20 | 2 | 5 |
| 17 | 33H | 20 | 3 | 2 |

Samples of an alloy containing copper, 25% nickel, an alloy used to make the UK 10p coin, were tested for weight loss and samples of the alloy copper, 2.5% zinc, 0.5% tin, an alloy used to make the 2p UK bronze coins were also tested in the form of trial coins. These tests were comparison tests for wear tests on trial coins of the alloys copper, 20% zinc, 5% tin and copper, 25% zinc, 5% tin, 5% nickel. The results of these tests are given in FIG. 2. Line 1 illustrates the weight loss in percentage against time for the alloy copper, 25% zinc, 5% tin, 5% nickel. Line 2 illustrates the weight loss for the alloy copper, 20% zinc, 5% tin. By comparison line 3 illustrates the weight loss for the alloy copper, 25% nickel and line 4 illustrates the weight loss for the alloy copper, 2.5% zinc, 2% tin.

It can be seen, therefore that both Alloy 33, i.e. the alloy containing 25% zinc, 5% tin, 5% nickel, balance copper, and Alloy 3, copper, 20% zinc, 5% tin are extremely resistant to wear.

To assess the alloys practically a series of trials were carried out in the pockets of two individuals. The alloys were made into coins and were carried for 14 weeks in the pockets of two people. The alloys were then ranked visually and the results of the two individuals are given in Table VI.

TABLE VI

| | Tarnish Assessment After Pocket Testing Exposure 14 Weeks | |
|---|---|---|
| | Person 1 | Person 2 |
| 1 | 33 | (33) |
| 2 | 33D | (33D) |
| 3 | 33/1 | (33G) |
| 4 | 33/2 | (3) |
| 5 | 33E | (33E) |
| 6 | 3 | (33C) |
| 7 | 3/3 | (33/3) |
| 8 | 33G | (33B) |
| 9 | 33C | (33/1) |
| 10 | 33A | (33F) |
| 11 | 33F | (33/2) |
| 12 | 3/2 | (3/2) |
| 13 | 33/3 | (3/3) |
| 14 | 33B | (33H) |
| 15 | 33H | (33A) |
| 16 | 33I | (33I) |
| 17 | 3/1 | (3/1) |

Both rankings are given in order of the least tarnished sample being at the top. The ranking of Person 2 is shown in brackets and it can be seen that the ranking for Person 2 is not the same as for Person 1. This exemplifies a problem with tarnishing that when considering alloys for coins the results are subjective and can vary with the testing method or the person making the assessment. This makes the selection of coin alloys particularly difficult. The rankings of the alloys were then correlated and Table VII shows the overall ranking for the pocket testing trials over a period of 14 weeks.

TABLE VII

| Alloy No | % Zn | % Sn | % Ni |
|---|---|---|---|
| 33 | 25 | 5 | 5 |
| 33D | 20 | 4 | 4 |
| 33E | 20 | 5 | 2 |
| 33/1 | 25 | 3 | 5 |
| 33/2 | 25 | 5 | 3 |
| 3 | 20 | 5 | |
| 33/3 | 20 | 4 | 5 |
| 3/3 | 20 | 5½ | |
| 33G | 20 | 4 | 2 |
| 33C | 20 | 3 | 3 |
| 33B | 20 | 2 | 5 |
| 33F | 20 | 2 | 4 |
| 33A | 20 | 2 | 2 |
| 3/2 | 20 | 4½ | |
| 33H | 20 | 3 | 2 |
| 33I | 20 | 2 | 3 |
| 3/1 | 20 | 3½ | |

From the information given above it can be seen that the alloys of the invention are tarnish resistant and have an attractive yellow color.

Table VIII below is a summary of all of the tests, namely the static tarnish tests, the environmental wear tests and the pocket tests as carried out by the two individuals. It can be seen that Alloy 33 comes out particularly well in terms of static tarnishing and pocket trials with an intermediate position on environmental wear test results. Alloy 33D is also particularly balanced in terms of the results of the pocket trials, the static tarnish tests and the environmental wear tests. In general terms the differences within the groups of the Alloys 3 and 33 are extremely small and all of the alloys would be satisfactory although clearly the alloys having the higher positions in the trials, such as Alloy 33 itself, would be preferred. The alloys are ranked from 1 to 17 with number 1 being the best.

TABLE VIII

| | Comparison of Tests | | | |
|---|---|---|---|---|
| Alloy | Static Tarnish | Environmental Wear | Pocket Tests | |
| 3 | 12 | 3 | 6 | 4 |
| 3/1 | 14 | 13 | 17 | 17 |
| 3/2 | 16 | 4 | 12 | 12 |
| 3/3 | 13 | 12 | 7 | 13 |
| 33 | 2 | 11 | 1 | 1 |
| 33/1 | 3 | 7 | 3 | 9 |
| 33/2 | 4 | 15 | 4 | 11 |
| 33/3 | 10 | 1 | 13 | 7 |
| 33A | 5 | 14 | 10 | 15 |
| 33B | 7 | 16 | 14 | 8 |
| 33C | 8 | 10 | 9 | 6 |
| 33D | 9 | 8 | 2 | 2 |
| 33E | 6 | 6 | 5 | 5 |
| 33F | 1 | 9 | 11 | 10 |
| 33G | 15 | 2 | 8 | 3 |
| 33H | 11 | 17 | 15 | 14 |
| 33I | 17 | 5 | 16 | 16 |

Again it should be noted from Table VIII that the selection of a coin alloy requires a balancing of properties. No alloy occupies the number one position for all of the tests. However, Alloy 33 itself is particularly effective as a coin in terms of its color, its pocket results, its tarnishing resistance and it can be seen from FIG. 2 that it is resistant to wear—being much better than the current British 2p coin, for example, although it is not necessarily the leading alloy in the environmental wear test results.

The alloys of the invention are relatively easily coined, being reasonably soft to mint such that the loads imposed on the dies are sufficiently reasonable to give an acceptable tool life. The materials comprising the alloys are limited in composition for a number of reasons some of which inter-relate. Thus the zinc content has to be in the range 15 to 30% to take out the redness of the copper and to provide sufficient zinc oxide which is protective to the alloys. Tin has little effect on the color of the alloy but it does have a significant effect on tarnish resistance of the material. Nickel is beneficial in terms of improved tarnish resistance but has the effect of bleaching the alloy so that too much nickel leads to too pale an alloy color. Furthermore nickel and tin combine to form an intermetallic compound $Ni_3Sn$ which is hard and can adversely affect die life.

Overall, therefore, the ternary copper-zinc-tin alloys of the 3 Series have good tarnish resistance, a good color and are easily fabricated.

The quaternary copper-zinc-tin-nickel alloys of the 33 Series have outstanding tarnish resistance and, for optimum fabrication properties, should ideally have the total of the minor element concentrations below 11%. As a compromise improved tarnish resistance indicates maintaining both the tin and nickel levels in the 4 to 5% regions. From the point of view of cost the tin and nickel contents should be kept as low as possible. One particular alloy which had a good compromise between cost, color (pale yellow) and tarnish resistance is the alloy copper, 20% zinc, 4% tin, 2% nickel.

The electrical resistivity of Alloy 33 is 16 micro ohms/cm which is significantly above that of cold rolled 70–30 brass. Alloy 33 has useful age hardening properties which enable the alloy to be worked and coined in one state and subsequently heat treated to harden the alloy. The alloys have, therefore, useful metallurgical properties, are attractive in color and have all of the requirements of a coin alloy as set out above.

What is claimed is:

1. A coin wherein at least the surface of the coin is made of a copper-based alloy consisting essentially of from 20% to 30% (by wt) zinc, from 2% to 7% (by wt) tin, and up to 7% (by wt) nickel, the balance being copper apart from incidental impurities, said alloy being gold-colored, tarnish-resistant, fabricable, and wear-resistant, provided that when the alloy consists essentially of copper, zinc and tin, the alloy contains at least 3.5% (by wt) tin.

2. A coin according to claim 1 wherein the copper based alloy contains from 20% to 25% (by wt) zinc.

3. A coin according to claim 1 wherein the copper based alloy contains from 3% to 6% (by wt) tin.

4. A coin according to claim 3 wherein the copper based alloy contains from 4.5% to 5.5% (by wt) tin.

5. A coin according to claim 1 wherein the copper based alloy contains from 2% to 7% (by wt) nickel.

6. A coin according to claim 1 wherein the copper based alloy contains 20% (by wt) zinc and 5% (by wt) tin.

7. A coin according to claim 5 wherein the copper based alloy contains 25% (by wt) zinc, 5% (by wt) tin and 5% (by wt) nickel.

8. A coin according to claim 5 wherein the copper based alloy contains 20% (by wt) zinc, 4% (by wt) tin and 2% (by wt) nickel.

9. A coin according to claim 5 wherein the copper based alloy contains 20% (by wt) zinc, 4% (by wt) tin and 4% (by wt) nickel.

10. A coin according to claim 5 wherein the copper based alloy contains 20% (by wt) zinc, 5% (by wt) tin and 2% (by wt) nickel.

11. A coin according to claim 5 wherein the copper based alloy contains 25% (by wt) zinc, 3% (by wt) tin and 3% (by wt) nickel.

12. A coin according to claim 5 wherein the copper based alloy contains 25% (by wt) zinc, 3% (by wt) tin and 5% (by wt) nickel.

13. A coin according to claim 5 wherein the copper based alloy contains 25% (by wt) zinc, 5% (by wt) tin and 3% (by wt) nickel.

14. A coin according to claim 5 wherein the copper based alloy contains 25% (by wt) zinc, 5% (by wt) tin and 5% (by wt) nickel.

15. A coin wherein at least the surface of the coin is made of a copper-based alloy consisting essentially of from 20% to 30% (by wt) zinc and from 3.5% to 7% (by wt) tin, the balance being copper apart from incidental impurities, said alloy being gold-colored, tarnish-resistant, fabricable and wear-resistant.

16. A coin wherein at least the surface of the coin is made of a copper-based alloy consisting essentially of from 20% to 30% (by wt) zinc, from 3.5% to 7% (by wt) tin, and from 2% to 7% (by wt) nickel, the balance being copper apart from incidental impurities, said alloy being gold-colored, tarnish-resistant, fabricable and wear-resistant.

* * * * *